US006062906A

United States Patent [19]

Tanaka

[11] Patent Number: 6,062,906

[45] Date of Patent: May 16, 2000

[54] ELECTRICAL CONNECTOR AND RETAINING MEMBER THEREFOR

[75] Inventor: Nobuyoshi Tanaka, Yokkaichi, Japan

[73] Assignee: Sumitomo Wiring Systems, Ltd., Yokkaichi, Japan

[21] Appl. No.: 09/143,648

[22] Filed: Aug. 31, 1998

[51] Int. Cl.[7] ..... H01R 13/40

[52] U.S. Cl. ..... 439/595; 439/912

[58] Field of Search ..... 439/595, 744, 439/912, 752

[56] References Cited

U.S. PATENT DOCUMENTS

| | | | |
|---|---|---|---|
| 4,658,212 | 4/1987 | Ozawa et al. . | |
| 4,806,123 | 2/1989 | Konishi et al. . | |
| 4,944,696 | 7/1990 | Sueyoshi et al. . | |
| 5,088,938 | 2/1992 | Murakami et al. . | |
| 5,127,854 | 7/1992 | Fujitani et al. . | |
| 5,256,083 | 10/1993 | Yamamoto . | |
| 5,597,325 | 1/1997 | Maejima et al. | 439/595 |
| 5,607,327 | 3/1997 | Tsuji et al. . | |
| 5,629,627 | 5/1997 | Hoshino et al. . | |
| 5,694,043 | 12/1997 | Kodama . | |

FOREIGN PATENT DOCUMENTS

| | | |
|---|---|---|
| 7-73949 | 3/1995 | Japan . |

*Primary Examiner*—Khiem Nguyen
*Assistant Examiner*—J. F. Duverne
*Attorney, Agent, or Firm*—Greenblum & Bernstein, P.L.C.

[57] ABSTRACT

An electrical connector is provided that includes a hood surrounding a terminal housing having an open front end and a plurality of adjacent terminal receiving chambers for receiving and holding electrical terminals, and each terminal receiving chamber is provided with a resilient locking piece having a free end extending toward the open front end. The resilient locking pieces can be resiliently deflected by a respective terminal from a normal position upon insertion of the terminal within a respective terminal receiving chamber and can resiliently return to the normal position upon complete insertion of the electrical terminal to thereby engage a portion of the electrical terminal to prevent removal from the terminal receiving chamber. Additionally, an insertion space is formed between a wall of the terminal housing and the plurality of terminal receiving chambers, and a retaining member is configured to be inserted within the insertion space. The retaining member includes at least one retaining surface arranged to correspond with a respective resilient locking piece to prevent deflection thereof from the normal position. At least one recess is formed in the retaining member and positioned within an outermost end of a respective terminal receiving chamber to facilitate contact of only an outermost end of the respective electrical terminal by an end face of a probe pin of a test unit. When the retaining member is fully inserted within the insertion space, an outermost end of the retaining member lies substantially coextensive with an outermost end of the front end of the terminal housing. The retaining member also includes a flange projecting outwardly therefrom at the outermost end to facilitate removal thereof from the insertion space, and a recess is formed in the wall of the terminal housing for receiving the flange when the retaining member is fully inserted within the insertion space. A notch is formed in the wall and positioned within the recess, the notch permitting ready access to the flange for engagement of the flange by a tool to facilitate removal of the retaining member.

9 Claims, 9 Drawing Sheets

ELECTRICAL CONNECTOR AND RETAINING MEMBER THEREFOR

BACKGROUND OF THE INVENTION

1. Field of the Invention

The present invention relates to an electrical connector, and more particularly to an electrical connector having a retaining member configured to be inserted within an insertion space of the electrical connector to retain electrical terminals positioned within terminal receiving chambers of the electrical connector.

2. Description of Background Information

An example of a prior art electrical connector of the type including a retaining element provided therefor is found in U.S. Pat. No. 5,127,854. The prior art electrical connector disclosed therein includes a pair of terminal receiving chambers in which electrical terminals are received, and the electrical terminals may include female terminals having a resilient contact portion disposed therein. The terminal receiving chambers include resilient locking pieces for retaining the electrical terminals within the terminal receiving chambers. A cap-like retaining element is provided to overlie and surround the terminal receiving chambers, and the retaining member includes an elongate projection configured to engage within a slot of the terminal receiving chambers to press and hold the electrical terminals to prevent the terminals from becoming "loose" and to maintain alignment of the terminal held within the terminal receiving chamber.

However, because the cap-like retaining member is mounted over the outer end of the terminal receiving chamber, an amount of play may occur between the cap member and the terminal receiving chamber resulting in an amount of looseness of the terminal. Furthermore, due to the configuration of the retaining member as a cap-like member, an aperture is provided in the outer end of the cap to permit communication of an electrical terminal of another half of the connector for engagement of the second electrical terminal with the first electrical terminal. As disclosed in U.S. Pat. No. 5,127,854, the aperture within the cap-like retaining member is sized and positioned such that no access is possible with the outer end of the electrical terminal housed within the terminal receiving chamber. Thus, access by a probe pin of a test unit can only be made to the interior portion of the electrical terminal which causes contact with the resilient contact portion of the terminal and which may result in damage to the electrical terminal.

Another prior art electrical connector is disclosed in U.S. Pat. No. 4,944,696. The prior art electrical connector disclosed in this patent also includes terminal receiving chambers having resilient locking pieces that are resiliently biased to engage and retain an electrical terminal inserted therein. However, the terminal receiving chambers disclosed therein have a lower wall that includes the resilient locking piece, and the lower wall itself is resiliently deflectable to provide a latching arrangement for the electrical terminal inserted therein. Furthermore, a retaining member having an upwardly oriented latching pawl at a first end and a plurality of guide rails positioned along an upper surface thereof and extending to the second end, is insertable within the electrical connector with the latching pawl positioned to engage behind the resilient lower wall of the terminal receiving chamber to latch the retaining member in position with the guide rails positioned to engage below the terminal ends to aid in retaining the terminal in position.

However, due to the resilient lower wall of the terminal receiving chambers, the electrical terminal is subject to a "loose" fit, which could cause misalignment of and damage to the electrical terminal retained therein.

Additionally, neither of the above-described prior art electrical connectors provide the operator with any indication as to when the retaining member is properly and completely installed, and neither is provided with any structural configuration or means to facilitate the removal of the retaining member in the event disassembly of the electrical connector and the electrical terminals retained therein becomes desirable or necessary. Furthermore, neither of the above-described prior art electrical connectors provide structure to ensure that a probe pin of a test device, or other electrical component, can establish contact with only the outermost end of the electrical terminal received within the terminal receiving chamber to preclude damage to the electrical terminal that may be caused due to the probe pin entering the electrical terminal.

SUMMARY OF THE INVENTION

Accordingly, an object of the present invention is to prevent the abovementioned misalignment between electrical terminals inserted within the terminal receiving chambers of the electrical connectors.

Another object of the present invention is to provide an electrical connector with a retaining member configured to detect a faulty condition when the electrical terminals are not fully inserted within the terminal receiving chambers.

An additional object of the present invention is to provide an electrical connector with a retaining member and terminal housing configured to facilitate engagement of only the outermost end of the electrical terminal by another electrical device.

A further object of the invention is to provide an electrical connector with a retaining member providing an audible and/or visual indication of complete and proper insertion of the retaining member within the electrical connector.

An additional object of the invention is to provide an electrical connector with a terminal retaining member that is configured to facilitate the removal thereof in the event disassembly of the electrical connector is desired.

According to a first aspect of the invention a connector is provided that includes a hood surrounding a terminal housing that includes a plurality of adjacent terminal receiving chambers for receiving and holding electrical terminals, and each terminal receiving chamber is provided with a resilient locking piece having a free end that extends toward an open front end of the terminal housing. The resilient locking pieces are configured to be resiliently deflected by a respective electrical terminal upon insertion of the electrical terminal within a respective terminal receiving chamber from a normal position and to resiliently return to the normal position upon complete insertion of the electrical terminal into the terminal receiving chamber. A portion of the electrical terminal is thereafter engaged by the resilient locking piece to prevent removal of the terminal from the terminal receiving chamber. An insertion space is provided between a wall of the terminal housing and the plurality of terminal receiving chambers. Furthermore, a retaining member, which is configured to be inserted within the insertion space, includes a plurality of retaining surfaces, each of which are arranged to correspond with a respective resilient locking piece to prevent deflection of the resilient locking pieces from their normal position. A plurality of recesses are formed in the retaining member and are arranged such that each recess is positioned within an outermost end of each respective terminal receiving chamber to facilitate contact of only an outermost end of the respective electrical terminal by the end face of a probe pin of a test unit. An example of a test unit having such a probe pin is shown in U.S. Pat. No. 4,658,212, the entire disclosure of which is incorporated by reference.

According to a further aspect of the electrical connector of the present invention, an outermost end of the retaining member lies substantially co-extensive with an outermost end of the front end of the terminal housing when the retaining member is fully inserted within the insertion space of the terminal housing. This not only provides a compact configuration for the electrical connector, but provides a visual and tactile indication as to whether or not the retaining member has been fully and properly inserted within the insertion space.

In an additional aspect of the present invention, the retaining member includes a flange which projects outwardly therefrom at the outermost end to facilitate removal of the retaining member from the insertion space. A recess is provided in the wall of the terminal housing at the outer end thereof for receiving the flange when the retaining member is fully inserted within the insertion space, and a notch is formed in the wall at a location within the recess. The notch permits ready access to the flange of the retaining member for engagement of the flange by a tool to facilitate removal of the retaining member.

According to another aspect of the present invention, the retaining member further includes a plurality of elongated projections that are sized to underlie and support one side of each electrical terminal without substantial play when the electrical terminals are fully inserted within the terminal receiving chambers. The retaining member may further include a plurality of longitudinally extending guide rails positioned intermediate the elongate projections and configured to engage between adjacent terminal receiving chambers with a close sliding tolerance so that the electrical terminals positioned within the terminal receiving chambers are supported without play.

According to a further feature of the invention, a latching member is formed on a side of at least one of the guide rails of the retaining member, and a recess or opening is formed in a wall of a corresponding terminal receiving chamber. Thus, when the retaining member is fully inserted within the insertion space, the latching member abuts an edge of the opening to inhibit removal of the insertion member. Furthermore, the latching member and the terminal receiving chamber are configured so that the latching member rides along a shallow groove in a wall of said terminal receiving chamber during insertion, and an audible and tactile signal is produced when the latching member enters the recess or opening.

According to an additional feature of the invention, at least one guide rib is formed on the wall of the terminal housing within the insertion space, and at least one guide groove is formed on the retaining member for cooperation therewith to aid in inserting the retaining member within the insertion space.

BRIEF DESCRIPTION OF THE DRAWINGS

The above and other features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

The electrical connector of the present invention will be described in detail with reference to the figures of the drawings.

Figure 1:
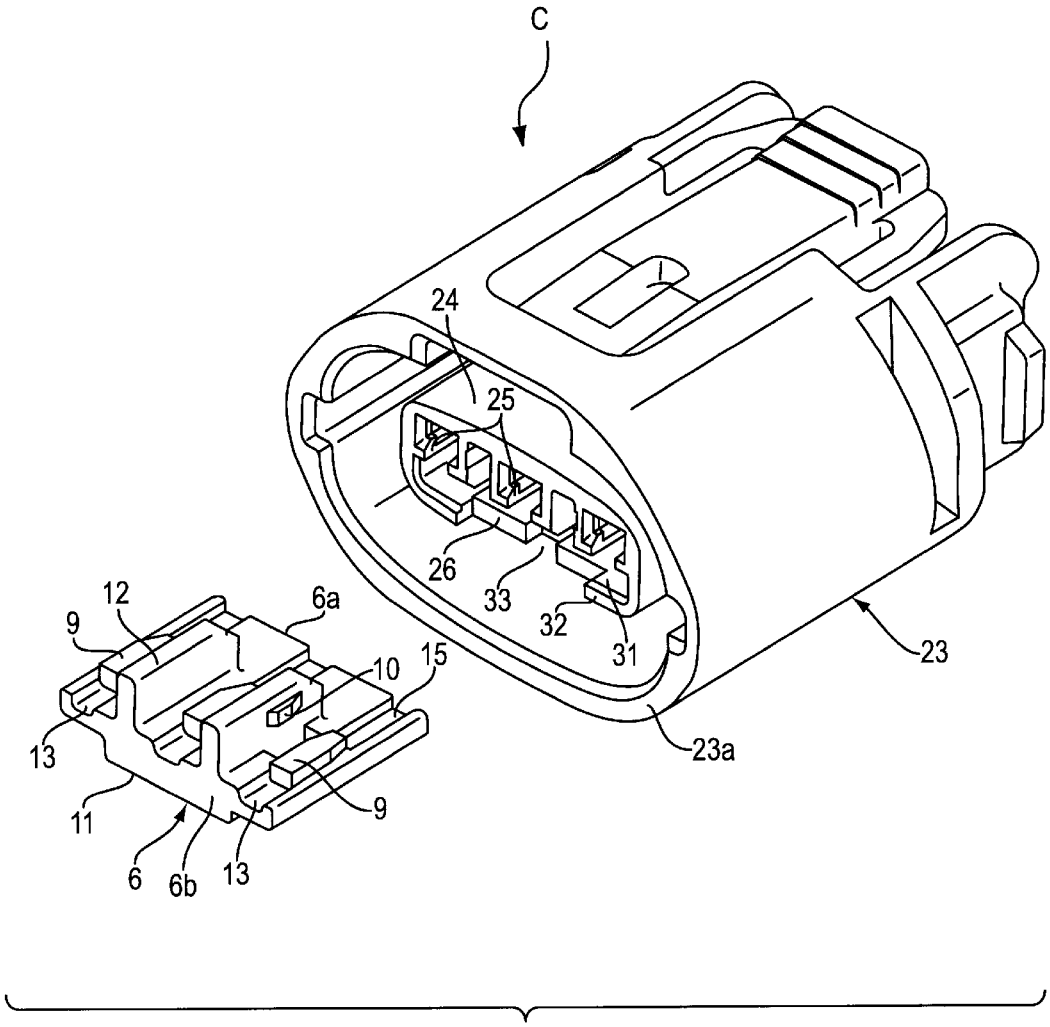
FIG. 1 is a front perspective view of the electrical connector according to the invention showing the retaining member removed.
Figure 2:
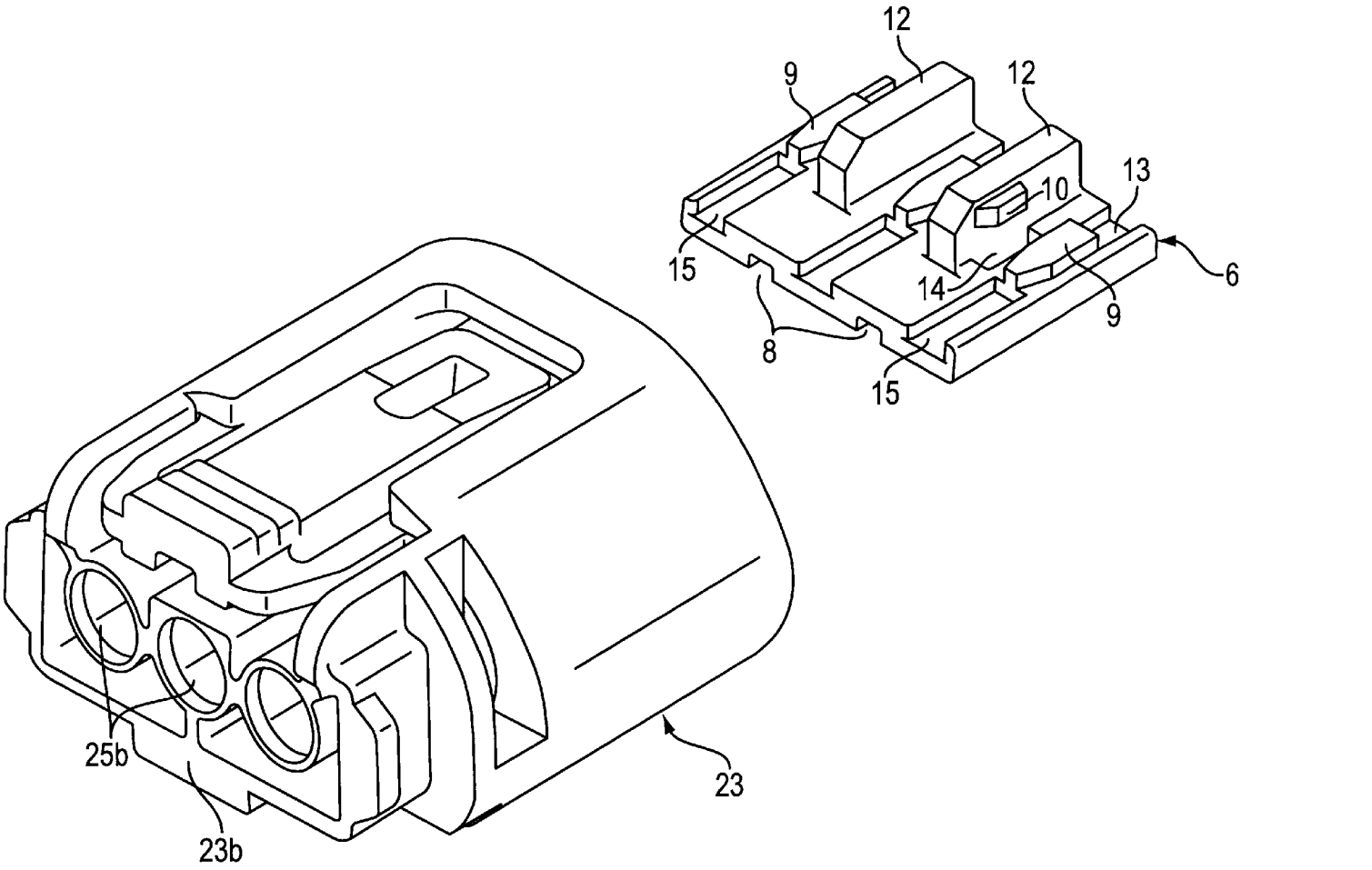
FIG. 2 is a rear perspective view of the electrical connector according to the invention showing the retaining member removed.
Figure 3:
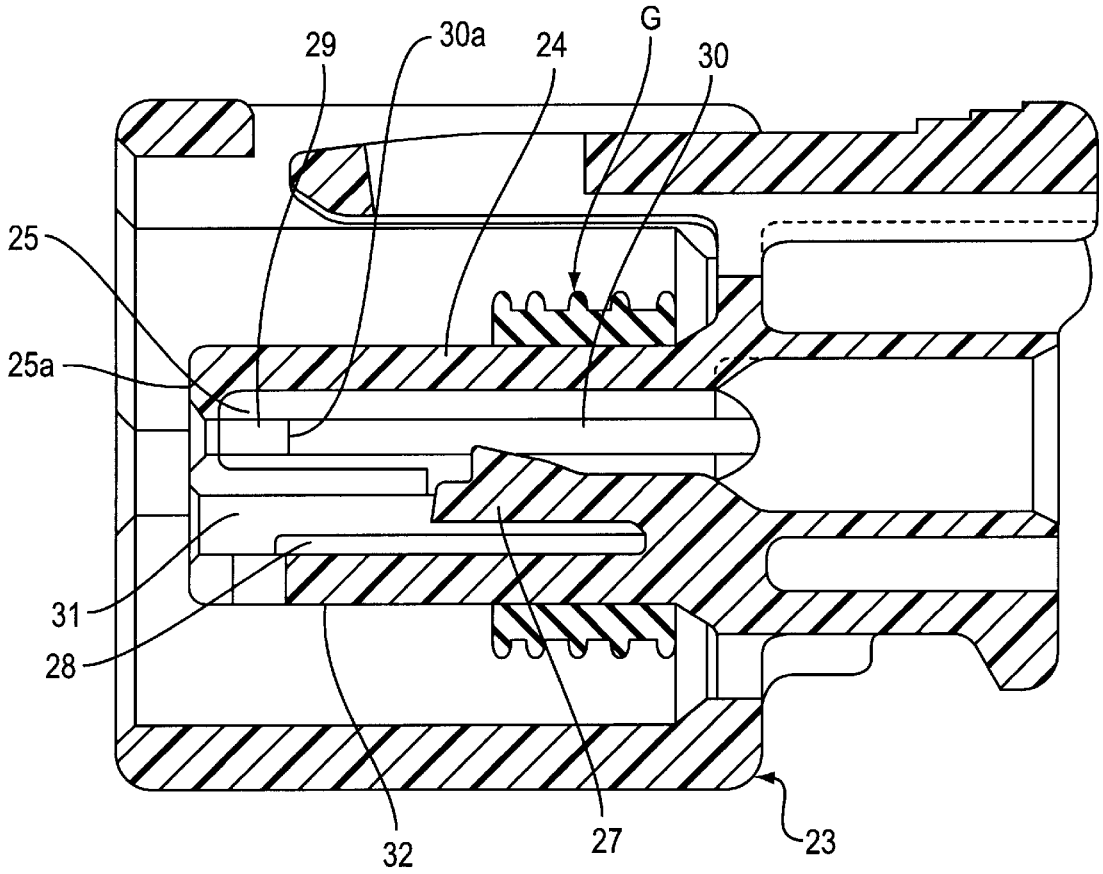
FIG. 3 is a vertical sectional view taken along the line 3—3 of FIG. 4.

Referring first to FIGS. 1–3, a female connector C is shown that includes a hood 23 surrounding a terminal housing 24 disposed therein in spaced relationship to the outer walls of the hood 23 for receipt of a male connector not shown). The space between the terminal housing 24 and the outer walls of the hood 23 may also receive a waterproof gasket or seal G for forming a waterproof connection between the male connector and the female connector C. The female connector C may be formed by any known method, preferably by molding, and may be formed of any known electrical insulating material, for example, a synthetic plastic material. The terminal housing 24 includes at least one terminal receiving chamber 25, and a plurality of spaced terminal receiving chambers 25 are shown in the drawings, each having a front end 25*a* and a rear portion 25*b* for receiving an electrical terminal T (FIG. 10) to be inserted therein from the rear end of the connector.

Figure 4:
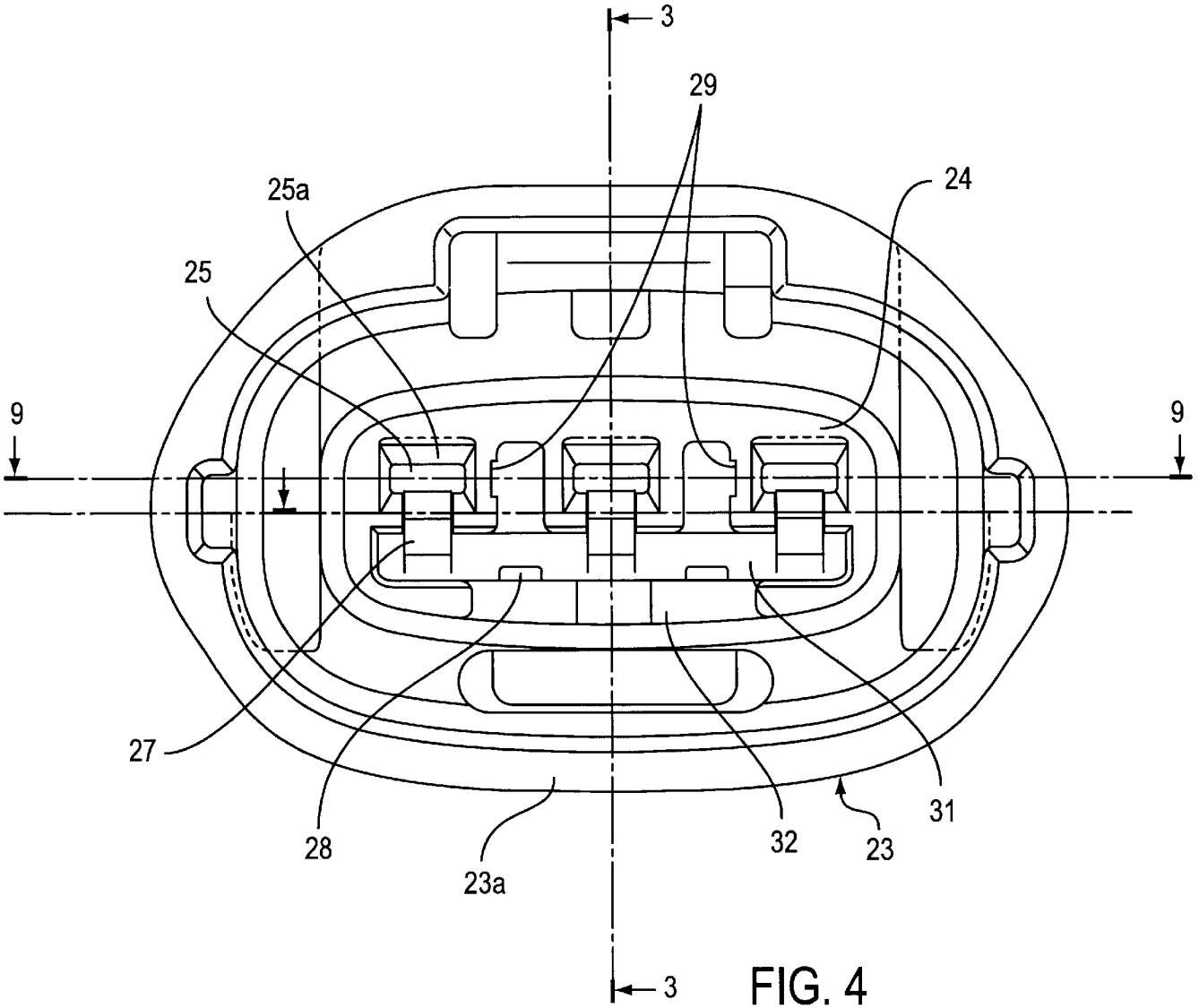
FIG. 4 is a front end view of the female connector according to the present invention with the retaining member removed.
Figure 5:
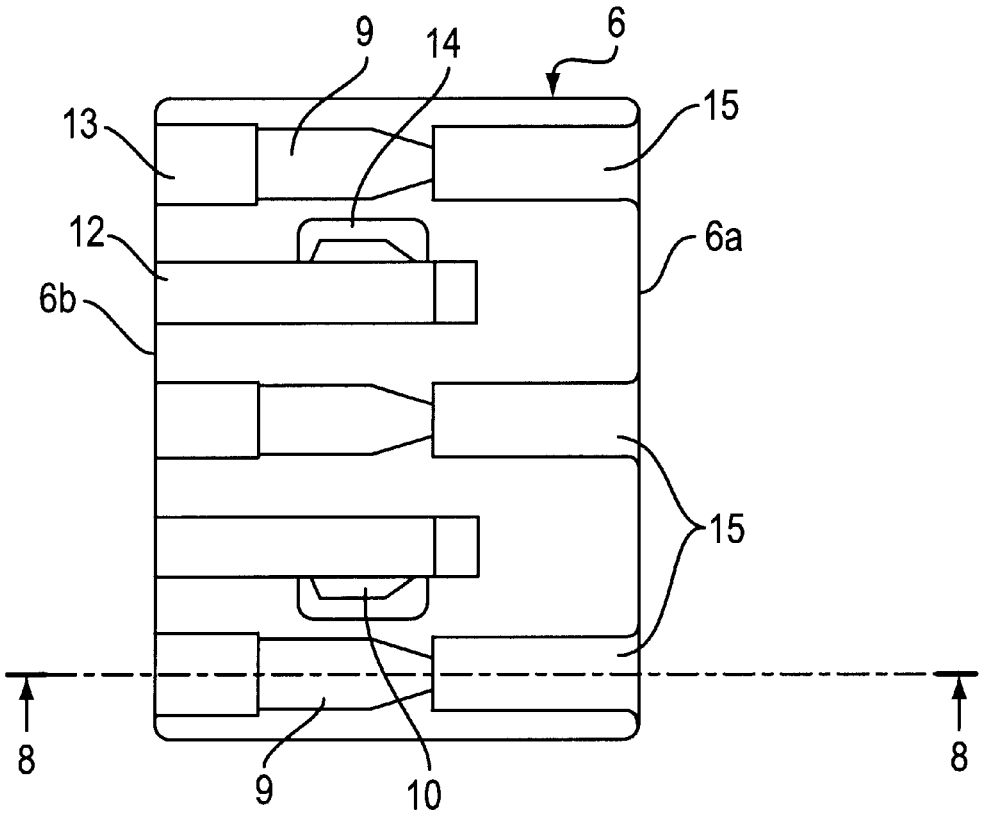
FIG. 5 is a top plan view of the retaining member according to the present invention.
Figure 9:
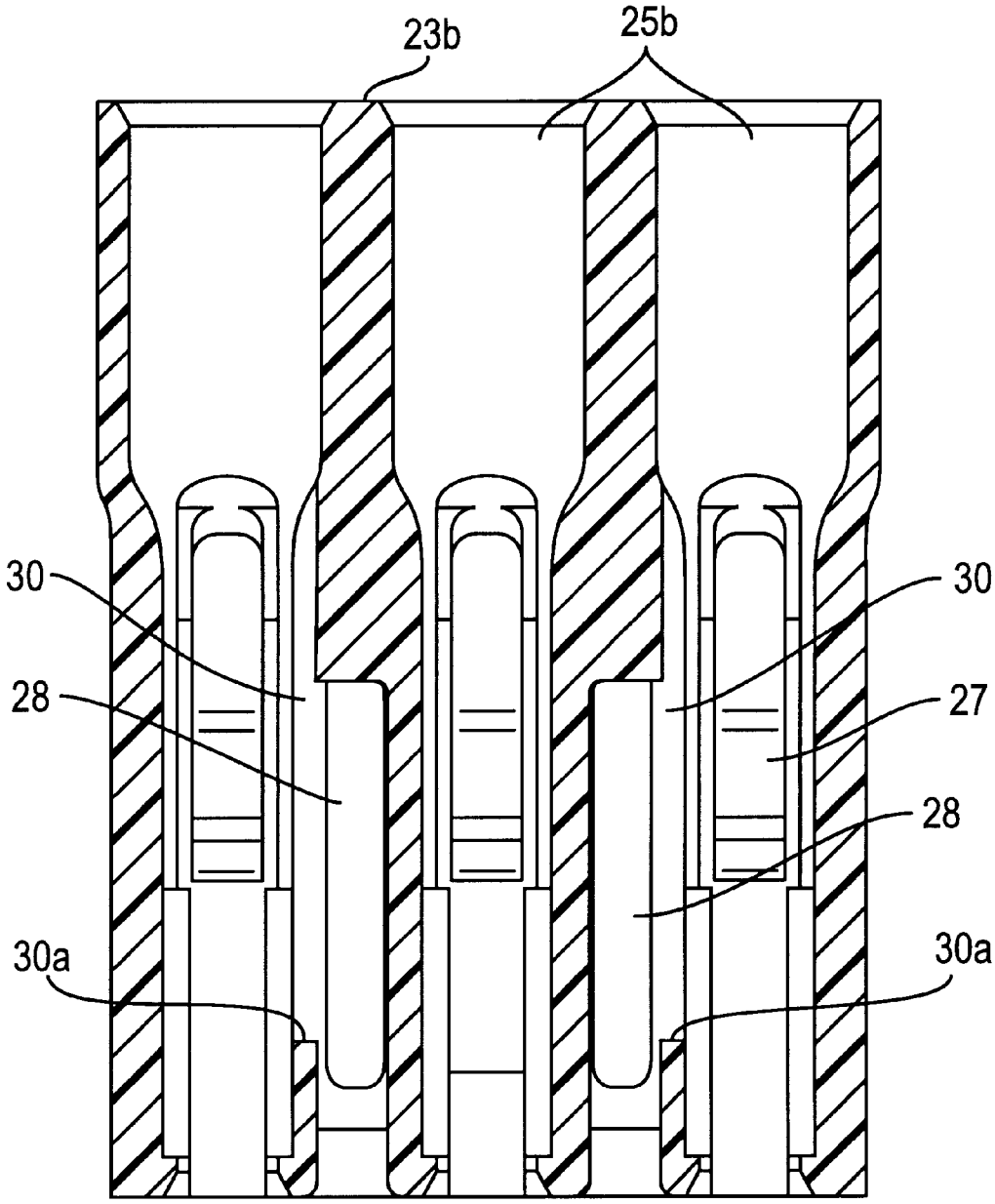
FIG. 9 is a horizontal cross sectional view of the female connector portion of the present invention taken along the lines 9—9 of FIG. 4.
Figure 10:
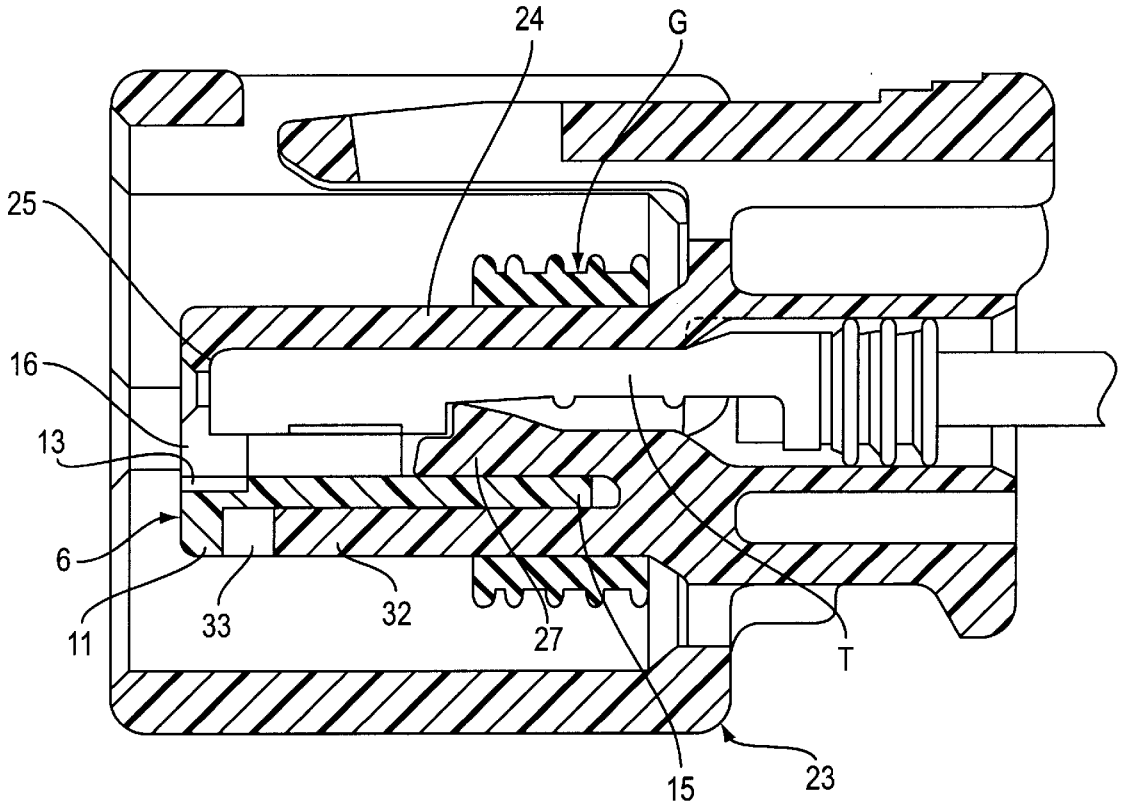
FIG. 10 is a sectional view similar to that of FIG. 3 but showing a conventional electrical terminal inserted within the connector and retained in position by the retaining member of the present invention.

Referring to FIGS. 3 and 10, the terminal housing 24 is integrally formed with a plurality of resilient locking pieces or lances 27, each of which is associated with a terminal receiving chamber 25, as seen in FIG. 4, and are configured to be deflected downwardly by an electrical terminal as it is inserted within the terminal receiving chamber 25. Once the electrical terminal T is fully inserted within the terminal receiving chamber, the resilient locking piece 27 is resiliently biased to return to its normal position, as shown in FIG. 10, to thereby engage a portion of the electrical terminal T to prevent removal thereof. As seen in FIGS. 1, 3 and 4, an insertion space 31 is provided between the lower wall 32 of terminal housing 24 and the plurality of terminal receiving chambers 25. Additionally, the lower wall 32 is provided with at least one longitudinally extending guide rib 28 (two such guide ribs 28 are depicted in the preferred embodiment shown in FIG. 4) that extends parallel to the terminal receiving chambers 25 for purposes to be described later. The lower wall 32 is further provided with a recess 26 and a notch 33 as clearly depicted in FIG. 1, also for purposes to be described later. Furthermore, at least one of the walls forming the terminal receiving chambers 25 includes a recess, which can be formed in any manner but is depicted as an opening 30 in the preferred embodiment of the present invention, as seen in FIGS. 3 and 9. Each recess or opening 30 includes a front end or stop 30*a* for purposes which will also be described later.

Turning now to FIGS. 1, 2 and 5–8, the retaining member 6 according to the present invention will now be described. The retaining member is formed as a separate member from the female connector C, for example by molding, from an insulating material that may be the same as or different from that forming the female connector C. As seen in FIGS. 1 and 2, the retaining member 6 has a front end 6*a* for insertion within the insertion space 31 of the terminal housing 24 and a rear end 6*b*. The retaining member 6 is formed on a first side thereof with a plurality of retaining surfaces 15 for engagement with the resilient locking pieces 27 to prevent movement thereof, as shown in FIG. 10. Retaining member 6 is also formed with a plurality of elongate projections 9 which are configured to engage a major portion of the lower surface of a electrical terminal T as depicted in FIG. 10. The retaining member 6 with projections 9, and the insertion opening 31 of the terminal housing 24, are configured to have complementary dimensions with close tolerances so that when the retaining member 6 is fully inserted within the insertion opening 31, movement of the electrical terminal T, once retaining member 6 is fully inserted within the terminal housing 24, is eliminated. Furthermore, the elongate projections 9 are tapered at the front end thereof to assist in insertion of the retaining member within the insertion space 31.

Figure 7:
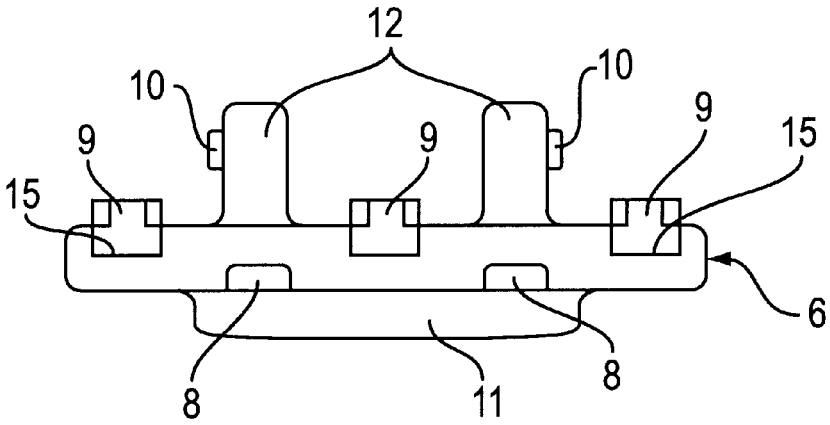
FIG. 7 is a front end view of the retaining member according to the present invention.

The retaining member 6 further includes at least one longitudinally extending guide rail 12, and preferably two such guide rails as shown in the preferred embodiment of FIGS. 1 and 7, that are configured to be positioned between adjacent terminal receiving chambers as apparent from FIG. 4 of the drawings. At least one of the guide rails 12 is provided with a latching member 10 (one latching member 10 has been shown for each of the guide rails 12 in the drawings, which is the preferred embodiment). In the preferred embodiment, the latching members 10 are formed integrally, for example by molding, with the guide rails 12 (note the mold access openings 14 in the retaining member 6 in FIGS. 2, 5 and 6) and project outwardly from the guide rails 12 and are spaced from the rear end 6*b* a distance such that the latching members 10 slide along the corresponding walls of the terminal receiving chambers 25 until the latching members 10 are received within the recesses or openings 30 of the terminal receiving chambers 25 as described earlier.

As can be seen in FIG. 4, shallow grooves 29 are provided in the walls defining the terminal receiving chambers 25 which cooperate with the latching members 10 to maintain the close tolerances required between the insertion space 31 of the terminal housing and the retaining member 6 while permitting relative sliding movement therebetween. The depth of the grooves 29 is considerably less than the distance the latching members 10 project outwardly from the sides of guide rails 12. Accordingly, once the entire latching member 10 is received within the opening 30, an audible, as well as tactile, signal is generated due to the interference fit as the latching members 10 "snap" into the corresponding recesses or openings 30. Additionally, the rearmost edge of each latching member 10 engages a respective stop 30*a* to inhibit removal of the retaining member from the insertion space 31.

Figure 6:
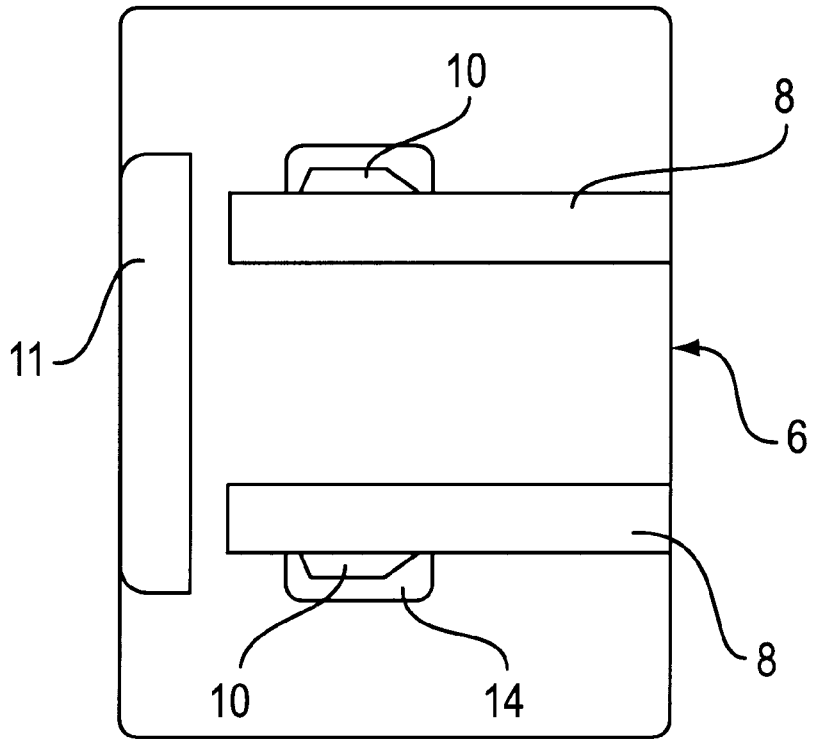
FIG. 6 is a bottom plan view of the retaining member according to the present invention.

The bottom side of retaining member 6 is formed with at least one guide groove 8 (two such guide grooves 8 are depicted in the preferred embodiment shown in FIG. 6). The guide grooves 8 cooperated with guide ribs 28 (as shown in FIG. 4) to aid in properly inserting the retaining member 6 within the insertion space 31.

Figure 8:
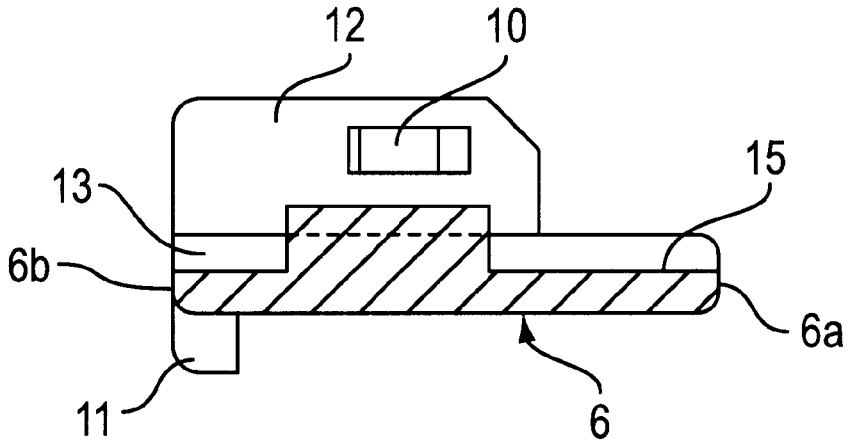
FIG. 8 is a vertical sectional view of the retaining member according to the present invention taken along the line 8—8 of FIG. 5.
Figure 11:
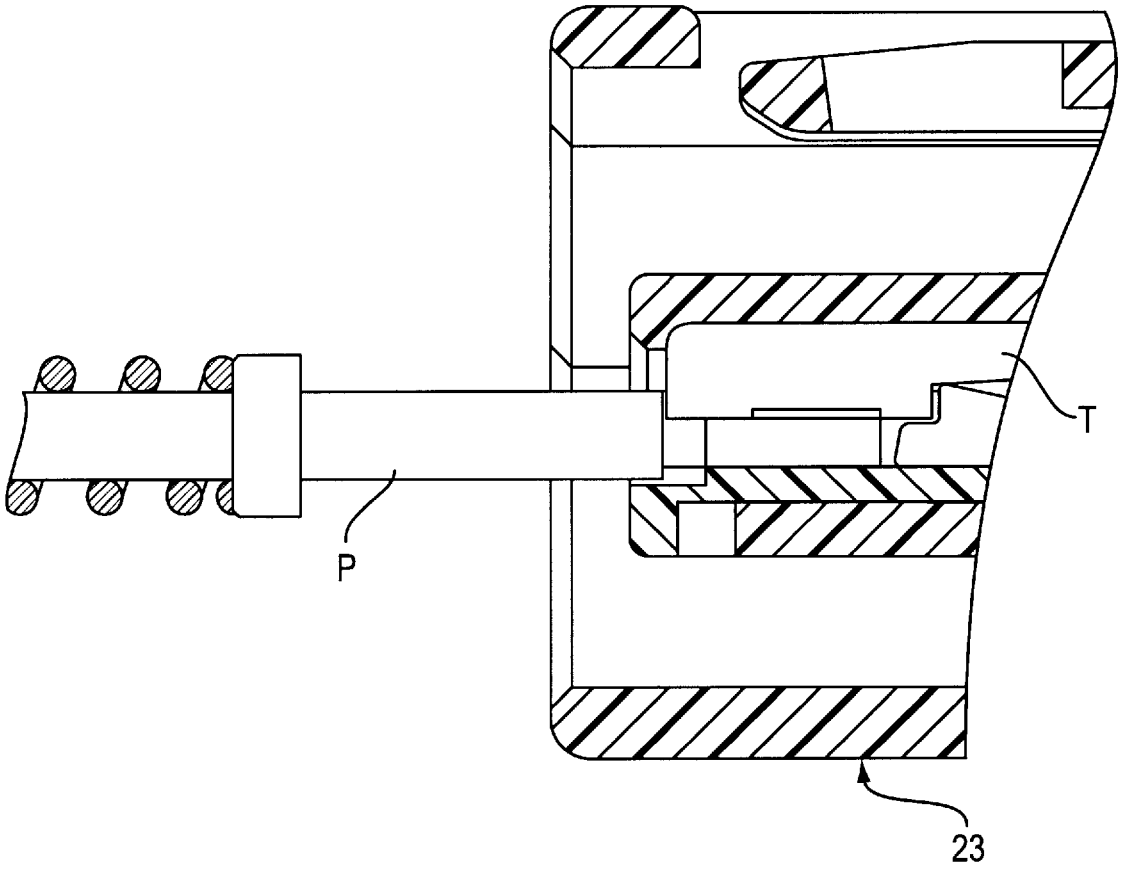
FIG. 11 is a partial sectional view similar to that of FIG. 10 and showing the end face of a probe pin contacting the outermost end of the electrical terminal inserted within the connector and retained in position by the retaining member in accordance with the present invention.

As can be seen in FIGS. 1, 2, and 8, the retaining member 6 includes a plurality of recesses 13 at the rear end thereof corresponding to the elongate projections 9. An important feature of the present invention results from the spacing of the elongate projections 9 from the rear end 6*b* of retaining member 6 and the recesses 13 which form a gap 16 as clearly seen in FIG. 10, that facilitates access only to the outermost end of the electrical terminal T by the end face of a probe pin P (as shown in FIG. 11), or other electrical device, of an electrical testing unit (not shown). This is important because it precludes the necessity for the probe pin of the test unit to enter within the outer end of the female electrical terminal T, as in prior art devices, in order to test the terminal, which thereby eliminates damage to the electrical terminal that may be caused by the probe pin.

The retaining member 6 is provided with a flange 11 at the rear end 6*b*, and the flange 11 projects outwardly from the body of the retaining member 6, as seen in FIGS. 1 and 8. This flange 11 is received within the recess 26 of the terminal housing 24 earlier described, and as a result, when the retaining member 6 is fully inserted within the insertion space 31 of terminal housing 24, the retaining member 6 and outer end of terminal housing 24 substantially co-terminate, as shown in FIG. 10. This not only provides a compact configuration for the electrical connector, but provides a visual and tactile indication as to whether or not the retaining member 6 has been fully and properly inserted within the insertion space 31.

As is also apparent from observing FIGS. 1 and 10 of the drawings, the notch 33 of the terminal housing 24 earlier described cooperates with the flange 11 of retaining member 6 to provide an access opening (note FIG. 10). As will be appreciated by those of ordinary skill, a tool, such as a small screwdriver, can be readily inserted within the access opening created by the flange 11 and notch 33 and placed in engagement with the flange 11 to enable the retaining member 6 to be pried from the insertion space 31 to facilitate removal thereof In this manner, the retaining force of the latching members 10 that engage the stops 30*a* to inhibit removal of the retaining member can be readily overcome, and removal of the retaining member 6 is facilitated thereby.

The operation of the electrical connector and retaining member according to the present invention will now be described with reference to FIGS. 1, 2 and 10. Initially, the appropriate number of electrical terminals T are inserted through the openings 25*b* in the rear end 23*b* of the hood 23. As the electrical terminals T are inserted, they engage and progressively deflect the resilient locking piece 27, as apparent from observing FIG. 10. Once the electrical terminals T are fully inserted within the terminal receiving chambers 25, the resilient locking pieces 27 are biased to return to their normal position as depicted in FIG. 3, after which the retaining member 6 is inserted into the insertion space 31.

Should any of the electrical terminals T be incompletely inserted into the terminal receiving chambers 25, this will result in the associated resilient locking piece 27 remaining in a deflected position. Thus, it is apparent that the front end 6*a* of retaining member 6 will engage the downwardly deflected outer end of resilient locking piece 27 within the terminal receiving chamber 25 having the incompletely inserted electrical terminal. The inability to completely insert the retaining member 6 within the insertion space 31 provides both a manual and visual warning to the operator that at least one of the terminals is improperly positioned and allows the operator to correct the erroneous situation.

However, in the event that all the electrical terminals are properly completely inserted within the respective terminal receiving chambers 25, the resilient locking pieces 27 will be biased upwardly to their normal terminal blocking position thereby allowing full insertion of the retaining member 6 into the insertion space 31. Furthermore, when the retaining member 6 is fully inserted, the latching members 10 abruptly move into the recesses or openings 30 for engagement with the stops 30*a* with a "snapping" sound. This provides the operator not only with an audible indication, but also a tactile indication, that the retaining member 6 has been filly inserted and is properly positioned. Additionally, because the retaining member 6 is configured to be completely inserted within the terminal housing 24 and to co-terminate with the outer end thereof incomplete insertion of the retaining member 6 within the insertion space 31 can be readily recognized by the operator since failure of retaining member 6 and the terminal housing 24 to coterminate would be readily observable both tactually and visually. Furthermore, if the connector is desired to be disassembled for any reason, the retaining member 6 can be removed by an operator by placing a tool such as a pry bar or small screwdriver within the access opening formed by the notch 33 and prying on the flange 11 of the retaining member 6 to thereby facilitate removal.

It will further be appreciated that the retaining member 6 with the guide rails 12, elongate projections 9 and retaining surfaces 15 are all sized to have close tolerances with the corresponding engaging portions of the terminal housing 24 to interfit with close sliding tolerances such that all of the electrical terminals T inserted within the terminal receiving chambers are maintained in a fixed position thereby obviating the problem of the terminal being "loose" within the electrical connector. Additionally, because the retaining member 6 is configured to be completely inserted within the terminal housing 24 and to co-terminate with the outer end thereof, the electrical connector of the present invention has a relatively compact configuration. Furthermore, because lie retaining member is inserted into the terminal housing from the outer end thereof, a more effective waterproof electrical connector can be formed.

Although the invention has been described with reference to particular means, materials, and embodiments, it is to be understood that the invention is not limited to the particulars disclosed and extends to all equivalents within the scope of the claims.

What is claimed:

1. An electrical connector comprising:

a hood surrounding a terminal housing, said terminal housing having an open front end and including a plurality of adjacent terminal receiving chambers for receiving and holding electrical terminals, each of said terminal receiving chambers provided with a resilient locking piece having a free end extending toward said open front end, said resilient locking pieces constructed and arranged to be resiliently deflected by a respective terminal from a normal position upon insertion of the terminal within a respective terminal receiving chamber and to resiliently return to said normal position upon complete insertion of the terminal into the terminal receiving chamber to thereby engage a portion of the terminal to prevent removal of the terminal from said terminal receiving chamber;

an insertion space formed between a wall of said terminal housing and said plurality of terminal receiving chambers, a recess formed in said wall of said terminal housing, and a notch formed in said wall and positioned within said recess;

a retaining member configured to be inserted within said insertion space, said retaining member including at least one retaining surface, each retaining surface arranged to correspond with a respective resilient locking piece to prevent deflection of said resilient locking piece from the normal position, and at least one recess formed in said retaining member and positioned within an outermost end of a respective terminal receiving chamber to facilitate contact only of an outermost end of the respective electrical terminal by an end face of a probe pin of a test unit; and wherein said retaining member further comprises a flange projecting outwardly therefrom at said outermost end to facilitate removal thereof from said insertion space, said recess formed in said wall of said terminal housing receives said flange when said retaining member is fully inserted within said insertion space, and said notch permits ready access to said flange for engagement of said flange by a tool to facilitate removal of said retaining member.

2. An electrical connector in accordance with claim 1, wherein an outermost end of said retaining member lies substantially coextensive with an outermost end of said front end of said terminal housing when said retaining member is fully inserted within said insertion space.

3. An electrical connector in accordance with claim 1, further including at least one longitudinally extending guide rib formed on said wall of said terminal housing within said insertion space and at least one guide groove formed on said retaining member for cooperation therewith to aid in inserting said retaining member within said insertion space.

4. An electrical connector comprising:

a hood surrounding a terminal housing, said terminal housing having an open front end and including a plurality of adjacent terminal receiving chambers for receiving and holding electrical terminals, each of said terminal receiving chambers provided with a resilient locking piece having a free end extending toward said open front end, said resilient locking pieces constructed and arranged to be resiliently deflected by a respective terminal from a normal position upon insertion of the terminal within a respective terminal receiving chamber and to resiliently return to said normal position upon complete insertion of the terminal into the terminal receiving chamber to thereby engage a portion of the terminal to prevent removal of the terminal from said terminal receiving chamber;

an insertion space formed between a wall of said terminal housing and said plurality of terminal receiving chambers;

a retaining member configured to be inserted within said insertion space, said retaining member including at least one retaining surface, each retaining surface arranged to correspond with a respective resilient locking piece to prevent deflection of said resilient locking piece from the normal position, and at least one recess formed in said retaining member and positioned within an outermost end of a respective terminal receiving chamber to facilitate contact only of an outermost end of the respective electrical terminal by an end face of a probe pin of a test unit; and wherein said retaining member is formed to have a generally planar portion with said recess formed in an upper surface thereof, and said retaining member further comprises at least one elongate projection raised above an upper surface of said planar portion and forming an end wall of said recess, said at least one elongate projection sized to underlie and support one side of an electrical terminal when the terminal is fully inserted within said terminal receiving chamber.

5. An electrical connector in accordance with claim 4, wherein said retaining member further includes at least one longitudinally extending guide rail positioned adjacent said elongate projection and configured to engage between adjacent terminal receiving chambers with close sliding tolerances such that said retaining member is easily inserted within said insertion space and is supported without play in said insertion space.

6. An electrical connector in accordance with claim 5, further including a latching member formed on a side of at least one said guide rail of said retaining member, and a recess formed in a corresponding terminal receiving chamber, whereby when said retaining member is fully inserted within said insertion space said latching member abuts an edge of said recess to inhibit removal of said retaining member.

7. An electrical connector in accordance with claim 6, wherein said recess is formed by an opening in a wall of said corresponding terminal receiving chamber.

8. An electrical connector in accordance with claim 6, wherein said latching member and said terminal receiving chamber are configured so that said latching member rides along a shallow groove in a wall of said terminal receiving chamber, during insertion, and an audible signal is produced when said latching member enters said recess.

9. An electrical connector in accordance with claim 8, wherein said recess is formed by an opening in a wall of said corresponding terminal receiving chamber.

* * * * *